United States Patent [19]

Schroder

[11] Patent Number: 4,926,976

[45] Date of Patent: May 22, 1990

[54] METHOD AND APPARATUS FOR THE CONTROL OF ELEVATOR CARS FROM A MAIN FLOOR DURING UP PEAK TRAFFIC

[75] Inventor: Joris Schroder, Lucerne, Switzerland

[73] Assignee: Inventio AG, Switzerland

[21] Appl. No.: 287,009

[22] Filed: Dec. 20, 1988

[30] Foreign Application Priority Data

Dec. 22, 1987 [CH] Switzerland ..... 05000/87

[51] Int. Cl.[5] ..... B66B 1/20

[52] U.S. Cl. ..... 187/125; 187/101

[58] Field of Search ..... 187/100, 101, 124, 125, 187/127, 128

[56] References Cited

U.S. PATENT DOCUMENTS

| | | | |
|---|---|---|---|
| 2,854,096 | 9/1958 | White et al. | 187/125 |
| 2,938,604 | 5/1960 | O'Grady et al. | 187/125 |
| 4,058,187 | 11/1977 | Jacoby et al. | 187/125 |
| 4,305,479 | 12/1981 | Bittar et al. | 187/125 |
| 4,838,384 | 6/1989 | Thangavelu | 187/125 |
| 4,846,311 | 7/1989 | Thangavelu | 187/125 |

FOREIGN PATENT DOCUMENTS

| | | |
|---|---|---|
| 0626924 | 1/1963 | Belgium . |
| 0030163 | 6/1981 | European Pat. Off. . |
| 2121212 | 12/1983 | United Kingdom . |

*Primary Examiner*—Philip H. Leung

*Assistant Examiner*—Duncanson, Jr. W. E.

*Attorney, Agent, or Firm*—Marshall & Melhorn

[57] ABSTRACT

A method and apparatus for the control of the dispatch of elevator cars from the main floor during up peak traffic conditions are implemented in an algorithm performed by a process computer. The algorithm for an elevator group, consisting of at least one elevator, calculates a transport capacity and a nominal time interval. The transport capacity and the nominal time interval are dependent on the nominal departure load and the compound values are stored in a transport capacity field and in an interval field, respectively. From data generated by a sensor, an elevator control and an input/output unit, the algorithm determines the traffic requirement at the main floor and the traffic requirement at an associated car, and the transport capacity is computed dependant on the higher of the two traffic requirements. Subsequently, the algorithm searches in the transport capacity field for the nominal departure load corresponding to this transport capacity. In a similar manner, the field component of the interval field, indexed with the nominal departure load, is addressed and the value of the field component assigned to the nominal time interval. As soon as the condition actual departure load equals nominal departure load or the condition actual time interval equals nominal time interval is satisfied, the associated car is dispatched.

36 Claims, 4 Drawing Sheets

METHOD AND APPARATUS FOR THE CONTROL OF ELEVATOR CARS FROM A MAIN FLOOR DURING UP PEAK TRAFFIC

BACKGROUND OF THE INVENTION

The present invention relates in general to a method and apparatus for the control of the dispatch of elevator cars from a main floor and,in particular, to such control during up peak traffic conditions A dispatch control for an elevator group consisting of several elevators is shown in the European Pat. No. 0 030 163, in which the dispatch interval is based on an approximate round trip time (RTT) of an elevator car, or on a mean round trip time based on the three preceding, approximate round trip times The round trip time is divided by the number of elevator cars serving the main floor to determine a mean dispatch time interval The approximate round trip time is the expected time which the elevator car requires for the up trip, serving the car calls registered at the main floor and the return trip to the main floor, and is calculated from building parameters, elevator installation parameters and operating condition parameters. If the elevator car has reached less than half its nominal load after expiration of the calculated dispatch interval time, the calculated interval time for the cars available at the main floor is shortened If the elevator car reaches, after expiration of the calculated dispatch time interval, at least half its nominal load, the interval time is shortened in a similar manner, however, with different weighting of the available cars.

A disadvantage of the above described control is that the actual dispatching time interval is determined on the basis f approximate round trip times calculated from past smaller than half the nominal load, and a departure load which is at least equal to half the nominal load, and in doing so shortens the interval time based on the number of cars available at the main floor There results again only an approximate matching with the effective variations of the traffic requirements. A consequence of both drawbacks is that the utilization of the elevator cars is not optimized.

SUMMARY OF THE INVENTION

The present invention solves the above described problem by creating a method in which the availability of transportation is matched to the demand for transportation at the main floor of an elevator installation In the present invention, the passengers, due to the variable conveying capacity of the elevators, profit from a service friendly to the user The car loading is matched to the upward-peak-traffic to maintain as smooth a traffic flow at the main floor as possible In an elevator group, each elevator car is driven by a hoisting machine supplied with electrical energy by a drive system. The drive system is controlled by an elevator control for the car which controls are connected to a process computer for the system A terminal connected to the process computer permits entry of the values for various constants used in an algorithm controller implemented in the computer. A sensor at the main floor provides information to the computer on the passengers entering the system and each car is also provided with a sensor connected to its associated control for providing data on the passengers in the associated car.

The algorithm is implemented as a series of steps defining a method for controlling the dispatch of the cars. In a first step sequence, the algorithm creates a transport capacity field and an interval field In a first cycle through the first step sequence, a transport capacity and a set point or nominal time interval are calculated as a function of the set point or nominal departure load where the value of the departure load is equal to one and is incremented by one each time The values of the calculated transport capacity and the calculated nominal time interval are stored in a field component of the transport capacity field and interval field respectively. Thus, the field components are filled with stored values as subsequent cycles through the first step sequence are completed.

In a second step sequence, the algorithm prepares the data necessary for the control of the dispatch of the cars. A traffic requirement is determined as a function of the destination calls received from the main floor sensor and a second traffic requirement is determined as a function of the actual departure load of the car to be dispatched. Subsequently, the algorithm calculates from the higher of the two traffic requirements the transport capacity and checks whether this value corresponds at least to the minimum transport capacity constant value The nominal departure load, corresponding to the calculated transport capacity, is established from the transport capacity field and the nominal time interval is established from the interval field utilizing the nominal departure load.

In a third step sequence, the algorithm evaluates the now known data for the control of the dispatch. The actual departure load is compared with the nominal departure load until equality prevails Simultaneously, a comparison is made between an actual time interval and the nominal time interval An OR-operator links both conditions, so that at equality of either comparison, the door closing command is generated by the computer to the corresponding elevator control which dispatches the car.

BRIEF DESCRIPTION OF THE DRAWINGS

The above, as well as other advantages of the present invention, will become readily apparent to those skilled in the art from the following detailed description of a preferred embodiment when considered in the light of the accompanying in which.

DESCRIPTION OF THE PREFERRED EMBODIMENT

The designations of the algorithm steps and the names of the devices in FIGS. 1 through 4, as well as the abbreviations of the constants, status variables, variables and field variables set forth in the column "Memo-Code" of Table 1 below, are used as reference symbols. Table 1 is a listing of the constants, status variables, variables and field variables involved in the method of according to the present invention. In FIGS. 1 through 4, reference symbols with and without indices are used Not indexed reference symbols refer to the elevator groups consisting of "n"elevators Reference symbols indexed with ".1, .2 ... .n"refer to the elevators "1, 2 ... n", respectively. A reference symbol indexed with ".x" refers to one of the elevators "1, 2 ...n". Some of the steps shown in FIGS. 3 and 4 require a determination whether constants, status variables or variables satisfy the triangularly shaped stated conditions A positive result of a determination is characterized with the reference symbol "J" and a negative result of a determination is characterized with the reference symbol "N" in each respective step.

TABLE 1

| Memo-Code | Constant |
|---|---|
| CF1 | calibrating factor one |
| CF2 | calibrating factor two |
| CF3 | calibrating factor three |
| CF4 | calibrating factor four |
| CF5 | calibrating factor five |
| CF6 | calibrating factor six |
| LCC | rated load |
| MTC | minimum transport capacity |
| NOC | number of elevators |
| NOF | number of floors |
| PAB | passenger access basis |
| **Memo-Code** | **Status variable** |
| CS.x | elevator start |
| DC.x | door closing command |
| DR.x | data inquiry |
| **Memo-Code** | **Variable** |
| DCL | destination calls |
| DDC | call difference |
| IT | actual time interval |
| IV | nominal time interval |
| LD | passenger access difference |
| LFB.x | actual departure load |
| PAT | passenger access time |
| PCA | boarding passengers |
| PCL | boarding passenger calls |
| SL | nominal departure load |
| TC | transport capacity |
| UT | traffic requirement |
| **Memo-Code** | **Field variable** |
| IVA | interval field |
| TCA | transport capacity field |

Figure 1:
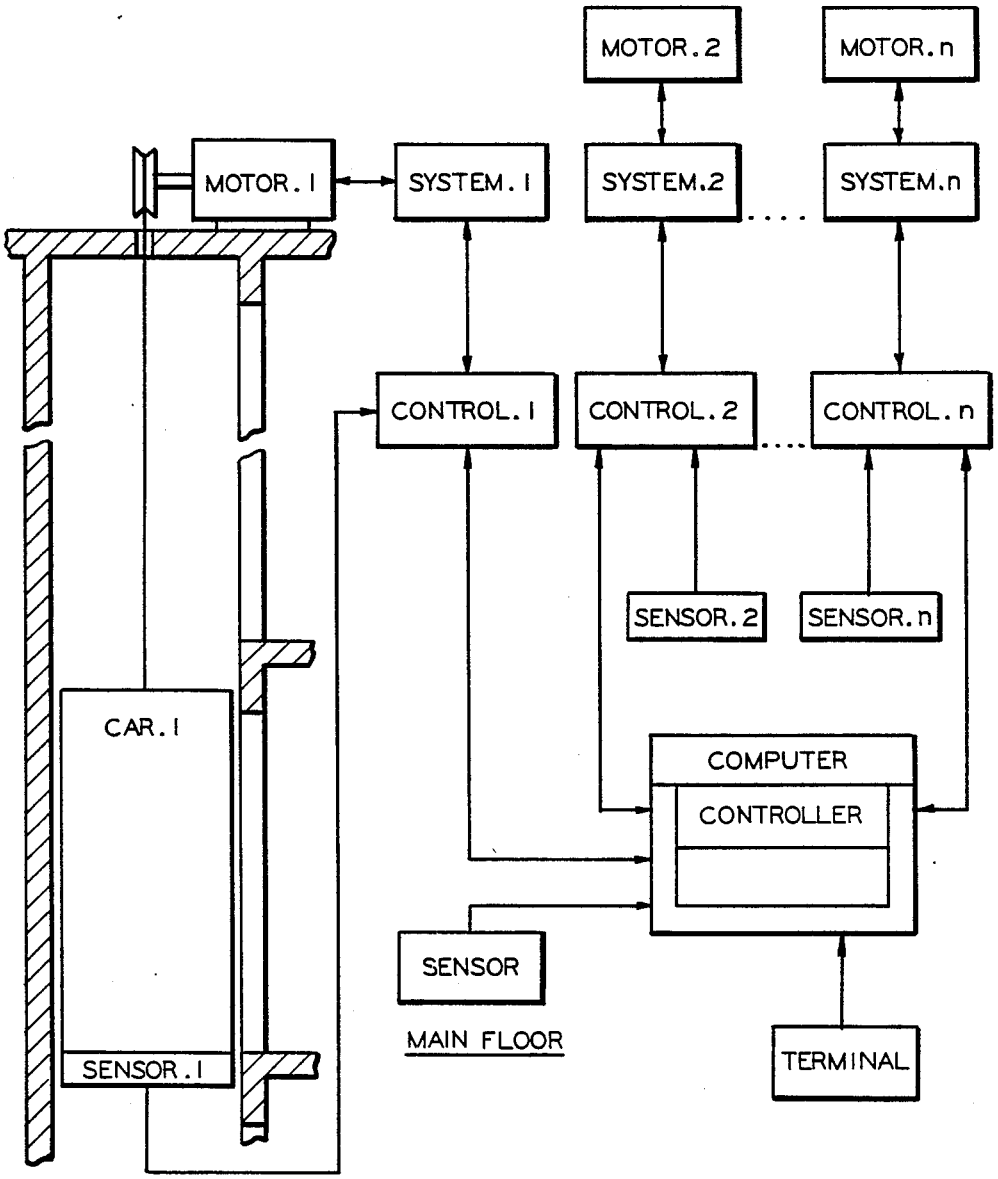
FIG. 1 a schematic block diagram presentation of an elevator group the method according to the present invention.

Shown in FIG. 1 is an elevator group consisting of "n"elevators. A hoisting machine MOTOR 1 drives an elevator car CAR.1 of the first elevator The hoisting machine MOTOR.1 is supplied with electrical energy by a drive system SYSTEM 1, which is connected to and controlled by an elevator control CONTROL 1 The detection of the building-filling passenger traffic departing from a main floor MAIN FLOOR and entering the first elevator car is made by load measuring devices or passenger counting devices, such as a sensor SENSOR.1 mounted in the elevator car CAR.1. The SENSOR.1 is connected with and sends its signal to the elevator control CONTROL 1. The elevators two through "n", with hoisting machines MOTOR 2. MOTOR.3 . MOTOR.n, drive systems SYSTEM.2, SYSTEM.3. SYSTEM n. elevator controls CONTROL.2. CONTROL.3... CONTROL.n. sensors SENSOR 2. SENSOR 3 .. SENSOR.n, and elevator cars CAR.2. CAR 3 . CAR.n (not shown) correspond in their construction and in their mode of operation to the first elevator described above.

Figure 2:
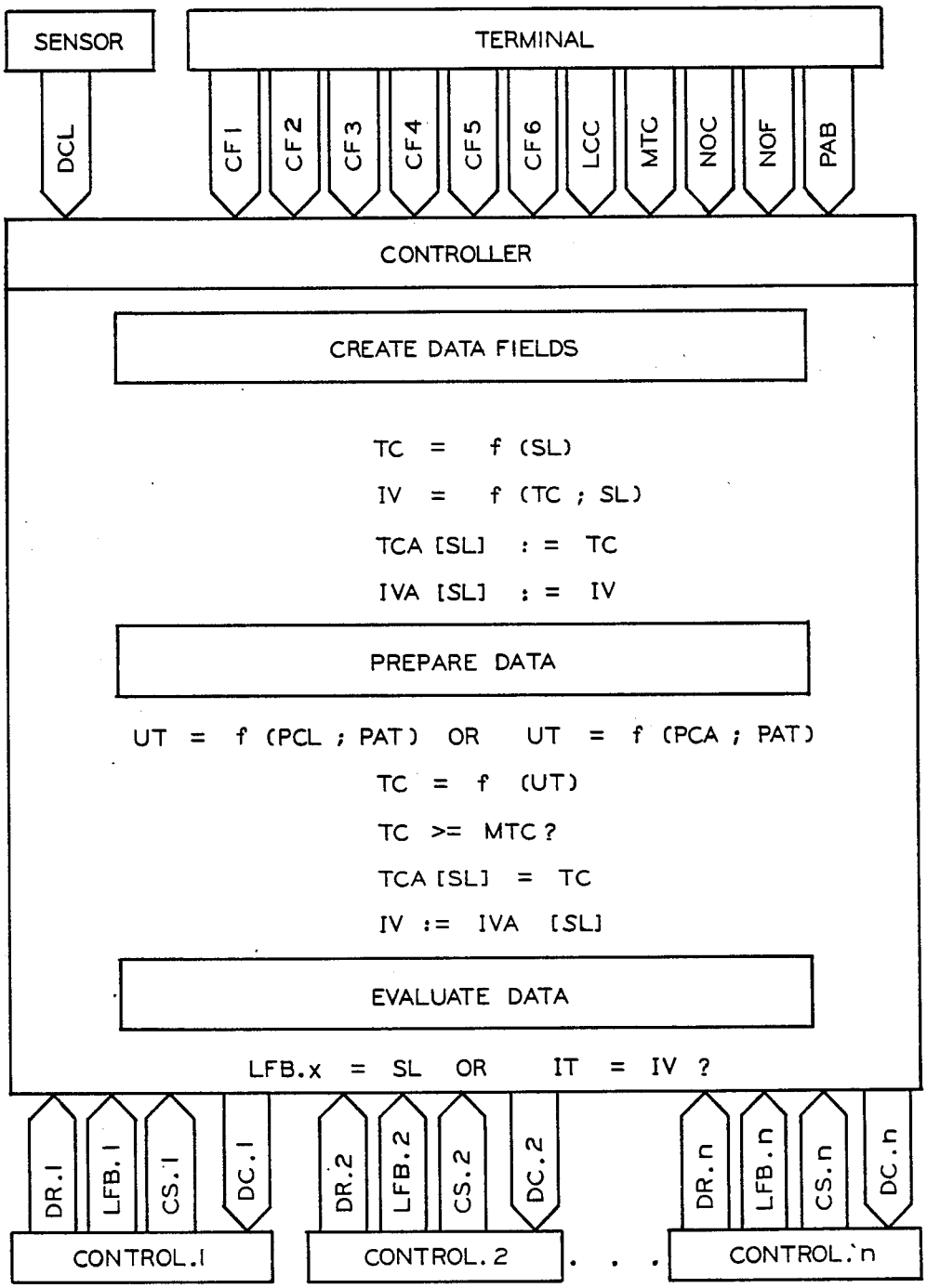
FIG. 2 is a schematic presentation of the data sources and data sin the elevator group of FIG. 1.

A sensor SENSOR located at the main floor MAIN FLOOR detects the arriving building-filling passenger traffic and is connected to a process computer COMPUTER which in turn is connected with the elevator controls CONTROL.1, CONTROL.2... CONTROL.n and with an input/output unit TERMINAL. An algorithm CONTROLLER, implemented in the process computer COMPUTER as, for example, a computer program, controls the dispatch of the elevator cars CAR 1, CAR 2 . CAR n Shown in FIG. 2 are the algorithm CONTROLLER implemented in the process computer COMPUTER and the data sources (inputs) and data sinks (outputs) connected to the process computer and utilized in the method according to the present invention Provided at the main floor MAIN FLOOR for the detection of the arriving building-filling passenger traffic are, as variants of the sensor SENSOR. light barriers, turnstiles, infrared detectors, field detectors or call registering devices which generate a destination calls signal DCL. The building filling passenger traffic originating at the main floor MAIN FLOOR and entering and departing the cars is detected by the sensors SENSOR.1. SENSOR.2. . SENSOR n, mounted in the elevator cars CAR 1, CAR.2 CAR.n respectively, and is sent to the elevator controls CONTROL 1. CONTROL 2 . CONTROL.n respectively Constants required in the method according to the present invention can be chosen and communicated to the algorithm CONTROLLER by means of the input/output unit TERMINAL. The destination calls DCL detected by the sensor SENSOR and actual departure loads LFB.1. LFB 2.. LFB n generated by the sensors SENSOR.x in the cars are variables which are inputted as first and second traffic measurement signals to the algorithm CONTROLLER and processed further. The values of the constants, calibrating factor one CFl, calibrating factor two CF2, calibrating factor three CF3, calibrating factor four CF4, calibrating factor five CF5, calibrating factor six CF6, rated load LCC, minimum transport capacity MTC, number of elevators NOC, number of floors NOF, and Passenger access basis PAB can be selected by the input/output unit TERMINAL and inputted as signals to the algorithm CONTROLLER in the process computer The elevator controls CONTROL 1. CONTROL 2. CONTROL n generate the status variables elevator start CS.1. CS 2. CS n. the actual departure loads LFB x from the sensors SENSOR x. and the data inquiry DR 1. DR.2 . DR n as signals to the algorithm CONTROLLER and receive from the algorithm CONTROLLER the status variables door closing command signals DC.1, DC.2... DC.n There is also shown in FIG. 2 the steps of the method according to the present invention In a first step sequence "Create data fields". the algorithm CONTROLLER creates a transport capacity field TCA and a time interval field IVA each having a plurality of field components. In a first cycle through the first step sequence, a transport capacity TC is calculated as a function of a set point or nominal departure load SL, and a set point or nominal time interval IV is calculated as a function of the transport capacity and the nominal departure load SL, where the value of SL is set equal to one. The values of the calculated transport capacity TC and of the calculated nominal time interval IV are stored in associated field components of the transport capacity field TCA and the interval field IVA respectively, the field components being represented by the symbol "[ ]". The symbol ":=" signifies an assignment of the value on the right side of the symbol to the variable on the left side of the symbol In subsequent cycles of the first step sequence, SL is increased in each case by one. The first step sequence is repeated until SL has reached the value of the rated load constant LCC.

In a second step sequence "Prepare data", the algorithm CONTROLLER prepares the data necessary for the control of the dispatch of a car. A traffic requirement UT is determined as a function of the destination calls DCL received from the sensor SENSOR and a second traffic requirement UT is determined as function of the actual departure loads LFB.x of the car to be used (CAR.x) as received from the elevator control CONTROL x and as will be described in connection with FIG. 4. Subsequently, the algorithm CONTROLLER calculates, from the higher of the two traffic requirements UT. the transport capacity TC and checks whether the value of TC is greater than or equal to the minimum transport capacity MTC. The nominal departure load SL, corresponding to the transport capacity TC just determined from the traffic requirement UT. is established from values stored in the transport capacity field TCA. The determination of the nominal time interval IV takes place in an analogous manner.

In a third step sequence "Evaluate data", the algorithm CONTROLLER evaluates the now known data for the control of the dispatch The actual departure load LFB.x is compared with the nominal departure load SL. until enough passengers have entered the car and equality prevails between the actual and the nominal values. Simultaneously, a comparison is made between an actual time interval IT and the nominal time interval IV. An OR-operator links both conditions. so that either at the equality LFB.x =SL or at the equality IT =IV. the door closing command DC.x is generated to the elevator control CONTROL x. which dispatches the associated car CAR.x.

Figure 3:
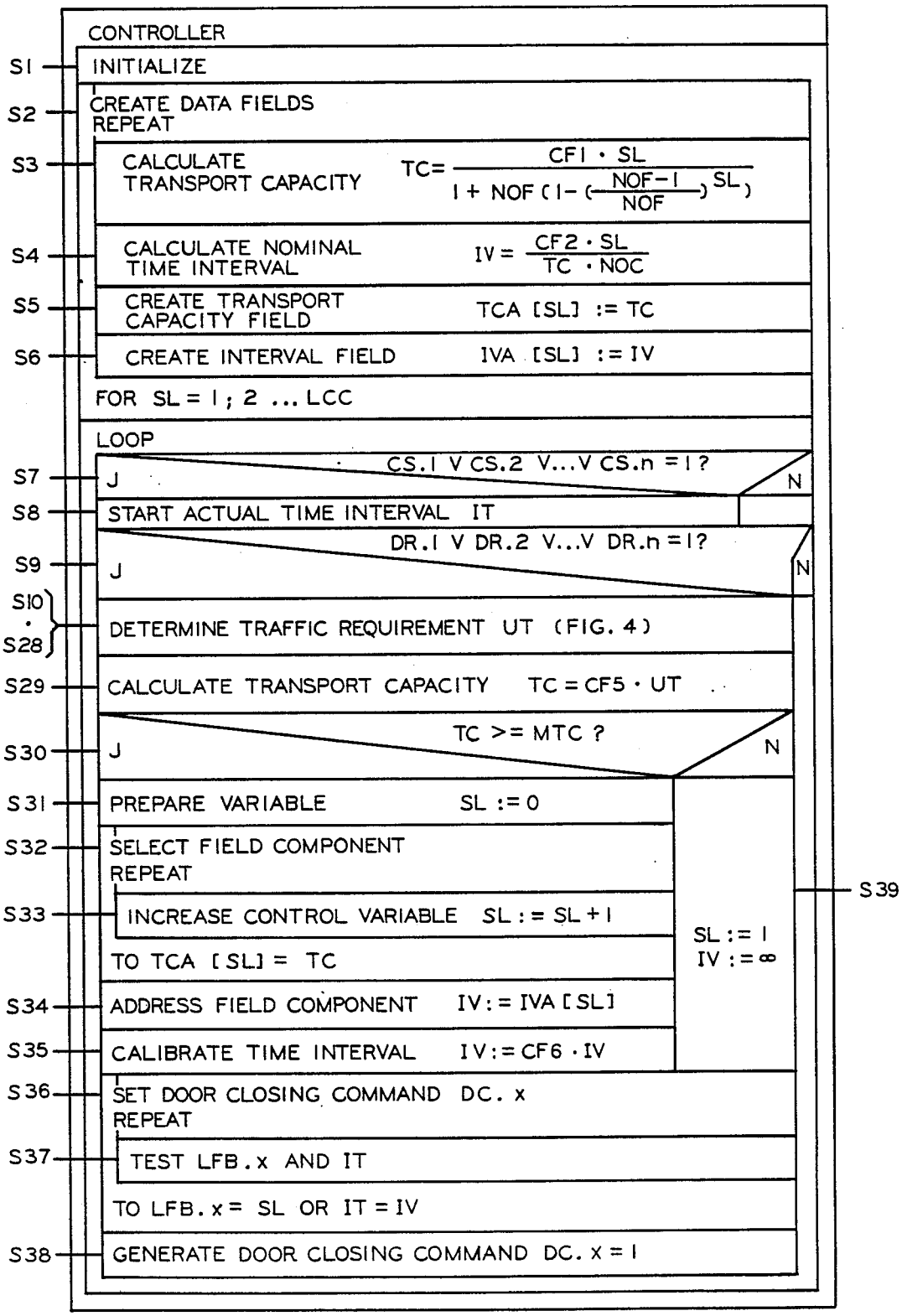
FIG. 3 is a flow chart of an algorithm for the dispatch of an elevator car of the elevator group of FIG. 1; and art of the algorithm for the FIG. 4 is a flow chart of the algorithm for the determination of the traffic requirement for an elevator car of the elevator group of FIG. 1.

FIG. 3 shows the structure and the sequence of the flow chart of the algorithm CONTROLLER. In a step S1 "Initialize", all constants and variables used in the algorithm CONTROLLER are set to the initial state. In a step S2. an iteration procedure comprising steps S3 through S6 for the calculation of the transport capacity TC and the nominal time interval IV. as well as for the creation of the data fields, transport capacity field TCA and interval field IVA. is carried out. In a first cycle of the iteration procedure shown in the step S2. the value of the nominal departure load SL is set to one, in a second cycle to two. and so on until the iteration procedure has been cycled LCC times In the step S3. the transport capacity TC is calculated as function of the nominal departure load SL. The calculation of the inclusive acceleration, deceleration, door and exiting losses is estimated at "m" seconds. From the number of stops and the stopping times, the round trip time can be calculated. The formula used in the step S3 for the calculation of the transport capacity TC results from the relation: transport capacity equals departure load divided by round trip time.

The calculation of the nominal time interval is carried out in the step S4. as a function of the calibrating factor two CF2, the nominal departure load SL. the transport capacity TC and the number of elevators NOC. In the step S5 and in the step S6. the transport capacity TC calculated in the step S3 and the nominal time interval IV calculated in the step S4 respectively are stored in the transport capacity field TCA and in the interval field IVA respectively Thus, the calculated values are assigned to the field components. indexed with SL, of the one dimensional data fields at every cycle of the iteration procedure.

The control "loop" starts with a step S7 in which it is checked whether the status variables elevator start CS.1, CS.2...CS.n, linked with the OR-operator "V" and generated from the elevator controls CONTROL.1. CONTROL 2.. CONTROL.n, have a value of one A positive result of the check, that is at least one elevator start signal CS x is present indicating the start of the previous car, justifies the start of the actual time interval IT shown in a step S8 In a step S9. it is checked whether data is requested from one of the elevator controls CONTROL.1. CONTROL.2. CONTROL n by means of the status variable data inquiry DR 1. DR 2. DR n and the data requesting elevator control CONTROL.x is identified. Thereby the algorithm CONTROLLER identifies the index ".x" of the actual departure load LFB.x to be received in subsequent steps and the door closing command DC.x to be generated in subsequent steps. A positive result of the check justifies the execution of steps S10. S11... S28, explained in FIG. 4, in which the traffic requirement UT is determined independently of the building-filling passenger traffic.

Figure 4:
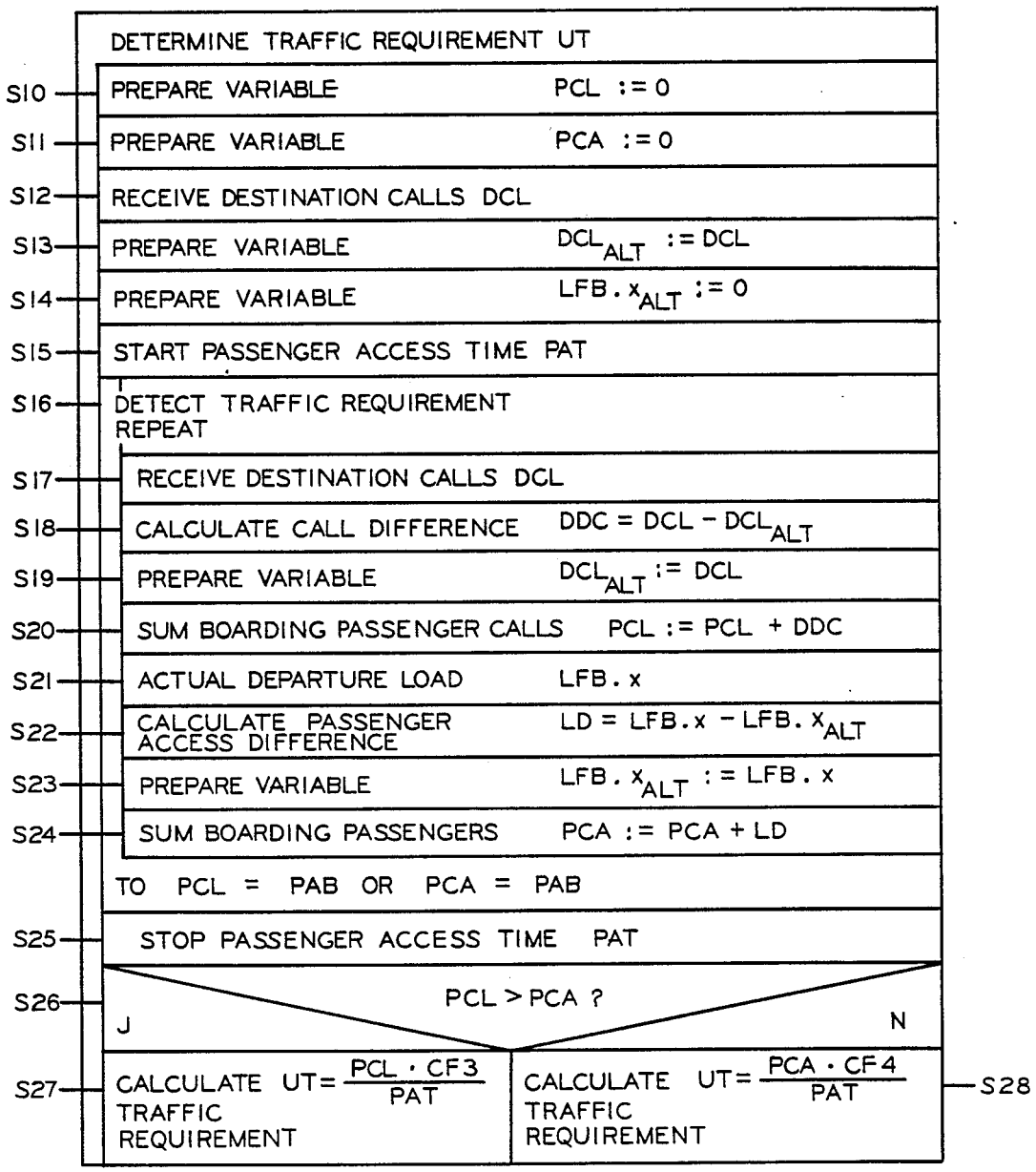

The traffic capacity TC is calculated in a step S29 from the calibrating factor five CF5 and the traffic requirement UT determined by the method shown in FIG. 4 The transport capacity TC. dependent on the traffic requirement UT. is checked in a step S30 as to whether it equals or exceeds the value of the minimum transport capacity MTC A negative result of the check justifies the execution of a step S39 wherein predetermined values of one and infinity are assigned to the nominal departure load SL and to the nominal time interval IV respectively. After the conclusion of the step S39, the algorithm CONTROLLER continues the control loop in a step S36 A positive result of the check performed in the step S30 justifies the execution of a step sequence S31, S32... S38. In the step S31. the nominal departure load SL is reset to zero In a first cycle of an iteration procedure represented by the step S32 and the step S33. the nominal departure load SL is set to one and the field component is indexed with SL The transport capacity field TCA is compared with the transport capacity TC calculated on the basis of the traffic requirement UT. At every cycle of the iteration procedure. the nominal departure load SL. the running variable. is increased by one and thereby the selected field component indexed with SL. The iteration procedure of the step S32 is repeated until the transport capacity TC stored in the transport capacity field TCA corresponds to the transport capacity TC calculated on the basis of the traffic requirement UT In the step S34. the field component indexed with SL is the interval field IVA which is addressed and the stored component value 11 1.7924 assigned to the variable nominal time interval IV.

The nominal time interval IV. addressed on the basis of the departure load SL and determined in the interval field IVA in the steps S32 and S33. is calibrated in the step S35 with the calibrating factor six CF6. The iteration procedure shown in the step S36 checks. in the step S37. the actual departure load LFB x of the selected car CAR.x and the actual time interval IT until either the actual departure load LFB x is equal to the nominal departure load SL or the actual time interval IT is equal to the nominal time interval IV. As soon as either one of the conditions is satisfied. the door closing command DC x is generated in the step S38 to the elevator control CONTROL.x. which dispatches the associated car CAR x. Thereby, the control loop of the algorithm CONTROLLER is terminated.

FIG. 4 shows the structure and the sequence of the flow chart of the algorithm CONTROLLER for the determination of the traffic requirement UT In the steps SlO. Sll. .S14. the variables necessary for the determination of the traffic requirement UT are prepared by resetting in the steps SlO and Sll a variable boarding passenger calls PCL and a variable boarding passengers PCA to zero In the step S12. the algorithm CONTROLLER receives the destination calls DCL detected by the sensor SENSOR. In the steps S13 and S14. values are assigned to the variables old destination calls DCLALT and old actual departure load LFB xALT. used for the determination of the traffic requirement UT. which are the value of the actual destination calls DCL and the value of the actual departure load LFB x (zero) respectively The detection of the traffic requirement UT is initiated in the step S15 with the start of a passenger access time variable PAT Carried out in the step S16 is an iteration procedure compromising the steps S17. S18 S24 for the detection of changes. with respect to the destination calls DCL and the actual departure load LFB.x. having occurred during the access time PAT.

In the first cycle of the iteration procedure illustrated in the step S16, the destination calls are received in the step S17 from the SENSOR at the main floor and a call difference DDC is calculated in the step S18 from the current destination calls DLC and the old destination calls $DCL_{ALT}$ Subsequently, the current value of the destination calls DCL is assigned to the old destination calls $DCL_{ALT}$ in the step S19 In the step S20, the call difference DDC is summed with the already detected boarding passenger calls PCL to generate a new value for PCL In the steps S21. S22.. S24. a cycle is performed which is identical with the cycle shown in the steps S17. S18 .. S20 and in which a passenger access difference LD is calculated and is summed with the already detected boarding passengers PCA. The iteration procedure illustrated in the step S16 is cycled until either the boarding passenger calls PCL or the boarding passengers PCA equal the value of the passenger access basis constant PAB received from the input/output unit TERMINAL. The detection of the traffic requirement UT is concluded at a step S25

In a step S26. a check is made whether. during the passenger access time PAT. more boarding passenger calls PCL were detected than boarding passengers PCA. A positive result of the check justifies execution of a step S27. in which the traffic requirement UT is precalculated. for example for five minutes. from the boarding passenger calls PCL and the passenger access time PAT A negative result of the check of the step S26 justifies execution of a step S28. in which the traffic requirement is precalculated, for example for five minutes, from the boarding passengers PCA and the passenger access time PAT. After the conclusion of the step S27 or the step S28. the algorithm CONTROLLER continues with the control loop at the step S29 in FIG. 3.

Although the algorithm shown in FIGS. 2–4 has been described in terms of a computer program for a general purpose programmed computer. it also could be implemented in discrete analog or digital circuitry Each of the arithmetic and comparison functions can be performed by circuit elements which are well known The present invention combines these known arithmetic and comparison functions into a new and unique method and apparatus for controlling the dispatch of elevator cars from a main floor. particularly during up peak traffic conditions.

In accordance with the provisions of the patent statutes. the present invention has been described in what is considered to represent its preferred embodiment However. it should be noted that the invention can be practiced otherwise than as specifically illustrated and described without departing from its spirit or scope.

What is claimed is:

1. A method for the control of the dispatch of elevator cars. during up peak traffic conditions from a main floor of an elevator group having at least one elevator, comprising the steps of:

a. detecting building filling passenger traffic arriving at a main floor by a first traffic measurement and detecting building.filling passenger traffic departing at the main floor by a second traffic measurement;

b. creating data fields by storing predetermined data related to transport capacities. nominal departure loads and nominal time intervals calculated according to an algorithm;

c. establishing nominal values of a departure load variable and a time interval variable dependent on said first and second traffic measurements and dependent on said predetermined data stored in said data fields and calculated according to said algorithm; and d. comparing an actual value of a departure load for each elevator car with said nominal departure load variable value established in said step c . and comparing an actual time interval with said nominal time interval variable value established in said step c. and, upon at least one of said actual values reaching said compared nominal value. dispatching an associated elevator car from the main floor.

2. The method according to claim 1 wherein said step b is performed by said algorithm determining. dependent on a calculation with said nominal departure load variable as a running variable, said transport capacities and storing said transport capacities in a transport capacity field.

3. The method according to claim 2 wherein said transport capacities are calculated according to an equation $$TC = \frac{CF1 \cdot SL}{1 + NOF(1 - ((NOF - 1)/NOF)SL)}$$

wherein CF1 is a predetermined calibrating factor one, SL is said nominal departure load variable and NOF is a number of floors serviced by the associated elevator cars of an elevator group.

4. The method according to claim 2 wherein said calculated transport capacity data is stored with said nominal departure load variable in the field components of a one-dimensional transport capacity field.

5. The method according to claim 1 wherein said step b is performed by said algorithm determining. dependent on a calculation with said nominal departure load variable as a running variable. said nominal time intervals and storing said nominal time intervals in an interval field.

6. The method according to claim 5 wherein said nominal time intervals are calculated according to the equation $$IV = (CF2 \cdot SL)/(TC \cdot NOC),$$

wherein CR2 is a predetermined calibrating factor two, SL is said nominal departure load, TC is said transport capacity and NOC is a number of elevators in an associated group of elevators.

7. The method according to claim 5 wherein said calculated nominal time intervals are stored in the field components. indexed with said nominal departure load variable. of a one.dimensional interval field.

8. The method according to claim 1 wherein said step c is performed by said algorithm initiating a control loop with the start of an actual time interval dependent on the preceding dispatch of an elevator car from the main floor and continuing said control loop in the absence of a data inquiry.

9. The method according to claim 8 wherein the start of said actual time interval is dependent on the logic function $$CS.1 \vee CS.2 \vee - \vee CS.n = 1$$

wherein CS.1 is an elevator start status variable of a first elevator control, CS.2 is an elevator start status variable of a second elevator control and CS.n is an elevator start status variable of an n.th elevator control of an associated elevator system.

10. The method according to claim 1 wherein said step a. is performed by said first traffic measurement detecting the arriving building.filling passenger traffic taking place at the main floor. and said second traffic measurement detecting the departing building.filling passenger traffic taking place at the associated car at the main floor. and said step c includes said algorithm. in response to a data inquiry from an elevator car, calculating a traffic requirement from said traffic measurements for use in establishing said nominal values.

11. The method according to claim 10 wherein said first traffic measurement is performed by a sensor arranged at the main floor for the detection of building-filling elevator passengers.

12. The method according to claim 11 wherein at least one of said sensors is a call registering device and said one sensor generates said first traffic measurement as a destination calls variable to said algorithm.

13. The method according to claim 10 wherein said second traffic measurement is performed by a sensor for the detection of boarding passengers mounted on an associated elevator car.

14. The method according to claim 13 wherein said sensor for the detection of boarding passengers is a load measuring device and said sensor generates an actual departure load variable to said algorithm.

15. The method according to claim 10 wherein said algorithm determines a first traffic requirement from said first traffic measurement performed by a sensor arranged at the main floor for the detection of building-.filling elevator passengers and said second traffic measurement performed by a sensor for the detection of boarding passengers on an associated elevator car, and uses the higher value of said traffic requirements for the calculation of a transport capacity.

16. The method according to claim 15 wherein said algorithm. after receiving a data inquiry, starts a passenger access time and stops said passenger access time after the arrival of a number of boarding passenger calls determined by a number of destination calls received or after the arrival of a number of boarding passengers determined by an actual departure load value received.

17. The method according to claim 16 wherein said number of destination calls or said number of boarding passengers can be selected by means of a constant passenger access basis value and said passenger access basis comprises at least one destination call or at least one boarding passenger.

18. The method according to claim 16 wherein said algorithm determines said number of boarding passenger calls from a summed call difference which is calculated according to the equation $DDC = DCL - DCL_{ALT}$, wherein DCL is the instantaneous state of said destination calls variable and $DCL_{ALT}$ is the previous state of said destination calls variable.

19. The method according to claim 16 wherein said algorithm determines said number of boarding passengers from a summed boarding passenger difference which is calculated according to the equation $LD = LFB.x - LFB.x_{ALT}$. wherein LFB.x is the instantaneous state of said actual departure load variable and $LFB.x_{ALT}$ is the previous state of said actual departure load.

20. The method according to claim 15 wherein said traffic requirement is calculated according to the equation $UT = PCL \cdot CF3/PAT$, wherein PCL is a number of boarding passenger calls variable CF3 is a predetermined calibrating factor three and PAT is a measured passenger access time.

21. The method according to claim 15 wherein said traffic requirement is calculated according to the equation $UT = PCA \cdot CF4/PAT$, wherein PCA is a number of boarding passengers, CF4 is a predetermined calibrating factor four and PAT is a measured passenger access time.

22. The method according to claim 1 wherein said step c. includes said algorithm calculating a transport capacity dependent on a traffic requirement calculated from said traffic measurements.

23. The method according to claim 22 wherein said transport capacity dependent on said traffic requirement is calculated according to the equation $TC = CF5 \cdot UT$, wherein calculated CF5 is a predetermined calibrating factor five and UT is said traffic requirement.

24. The method according to claim 1 wherein said algorithm assigns. at traffic requirement dependent transport capacities which are smaller than a predetermined minimum transport capacity, predetermined values to said nominal departure load variable and to said nominal time interval variable. said algorithm calculating said transport capacities dependent on a traffic requirement calculated from said traffic measurements.

25. The method according to claim 1 wherein said algorithm establishes said nominal departure load variable value from a transport capacity data field on the basis of a stored transport capacity dependent on a traffic requirement calculated from said traffic measurements.

26. The method according to claim 25 wherein for the determination of said nominal departure load from said transport capacity field. a field component indexed with said nominal departure load variable is selected which in terms of value. is identical to said transport capacity dependent on the traffic requirement.

27. The method according to claim 1 wherein said algorithm establishes said nominal time interval variable value from an interval data field on the basis of a nominal departure load variable value established from a transport capacity data field.

28. The method according to claim 27 wherein for the determination of said nominal time interval. a field component of said interval field associated with the value of said nominal departure load is addressed and a data value stored in said field component is assigned to said nominal time interval variable.

29. The method according to claim 1 wherein said algorithm calibrates said nominal time interval variable value determined from an interval data field dependent on a predetermined calibrating factor six.

30. The method according to claim 1 wherein said algorithm. upon loading of an associated car, performs said step d by comparing said actual departure load value, generated by an elevator control of said associated car. with said nominal departure load variable value determined from a transport capacity data field.

31. The method according to claim 1 wherein said algorithm. upon loading of an associated car. performs said step d. by comparing said actual time interval value started by a preceding dispatch of an elevator car from the main floor with said nominal time interval calibrated with a predetermined calibrating factor.

32. The method according to claim 1 wherein said algorithm, upon loading of an associated car. generates. at equality of said actual departure load value and said nominal departure load value or at equality of said actual time interval and said nominal time interval, a door closing command to an elevator control of said associated car.

33. An apparatus for controlling the dispatch of at least one elevator car during up peak traffic conditions from a main floor comprising:

a first sensor for generating a first traffic measurement signal representing building.filling Passenger traffic arriving at a main floor;

a second sensor for generating a second traffic measurement signal representing building.filling passenger traffic departing at the main floor;

means defining data fields for storing predetermined data related to transport capacities, nominal departure loads and nominal time intervals calculated according to an algorithm;

means for storing said algorithm and for calculating nominal values of a departure load variable and a time interval variable dependent on said first and second traffic measurement signals and dependent on said predetermined data stored in said data fields; and means connected to said first and second sensors. said means for storing and for calculating. and said means defining data fields for comparing an actual value of a departure load for an associated elevator car with said calculated nominal departure load variable value and for comparing an actual time interval with said calculated nominal time interval variable value and, upon at least of one said actual values reaching said compared nominal value. dispatching said associated elevator car from the main floor.

34. The apparatus according to claim 33 wherein said transport capacities are calculated according to an equation $$TC = \frac{CF1 \cdot SL}{1 + NOF(1 - ((NOF - 1)/NOF)SL)}$$

wherein CF1 is a predetermined calibrating factor one. SL is said nominal departure load variable and NOF is a number of floors serviced by the associated elevator cars of an elevator group.

35. The apparatus according to claim 33 wherein said nominal time intervals are calculated according to the equation IV=(CF2·SL)/(TC·NOC), wherein CR2 is a predetermined calibrating factor two SL is said nominal departure load. TC is said transport capacity and NOC is a number of elevators in an associated group of elevators.

36. An apparatus for controlling the dispatch of elevator cars of an elevator group having at least one elevator. during up peak traffic conditions. from a main floor comprising:

a call registering device for generating a first traffic measurement signal as a destination calls variable representing building filling passenger traffic arriving at a main floor;

a load measuring device for generating a second traffic measurement signal as an actual departure load variable representing building.filling passenger traffic departing at the main floor;

means for creating data fields by storing predetermined data related to transport capacities nominal departure loads and nominal time intervals calculated according to an algorithm;

means for calculating nominal values of a departure load variable and a time interval variable dependent on said destination calls variable and said actual departure load variable and dependent on said predetermined data stored in said data fields, and calculated according to said algorithm; and means connecting said call registering device. said load measuring device, said means for creating data fields and said means for calculating for comparing an actual value of a departure load for each elevator car with said nominal departure load variable value and comparing an actual interval with said nominal time interval variable value and upon at least one of said actual values reaching said compared nominal value. dispatching an associated one of said elevator cars from the main floor.

* * * * *